United States Patent [19]

Willis et al.

[11] 3,949,504

[45] Apr. 13, 1976

[54] LIGHTED DISPLAY FOR A CONSOLE

[75] Inventors: Wesley Nelson Willis, Mossley; Graham Stirling Laing, London, both of Canada

[73] Assignee: Northern Electric Company, Limited, Montreal, Canada

[22] Filed: Oct. 9, 1974

[21] Appl. No.: 513,230

[52] U.S. Cl. ..... 40/132 D; 40/133 B

[51] Int. Cl.[2] ..... G09F 13/04

[58] Field of Search ..... 40/132 D, 130 E, 130 D, 40/135, 133 R, 133 B, 130 L, 132 R, 219; 35/5, 6

[56] References Cited

UNITED STATES PATENTS

| | | | |
|---|---|---|---|
| 1,745,623 | 2/1930 | Kenerson | 40/135 |
| 1,888,584 | 11/1932 | Cadieux | 40/135 UX |
| 2,931,027 | 3/1960 | Blefary et al. | 40/130 E UX |
| 2,931,108 | 5/1960 | Brown | 35/5 |
| 3,010,235 | 11/1961 | Roberts et al. | 40/132 D |
| 3,163,949 | 1/1965 | Gley | 40/130 D |
| 3,584,401 | 6/1971 | Cryer et al. | 40/132 D X |
| 3,707,792 | 1/1973 | Mabrey et al. | 40/133 B X |
| 3,768,188 | 10/1973 | Kurtenbach et al. | 40/132 D X |

*Primary Examiner*—Louis G. Mancene
*Assistant Examiner*—John F. Pitrelli
*Attorney, Agent, or Firm*—Sidney T. Jelly

[57] ABSTRACT

A lighted display for a console, particularly for a telephone console for private branch exchanges, comprises a sandwich structure of a front transparent cover of a dark coloured material, an indicator layer or sheet of dark non-transparent material having transparent characters thereon and a plurality of lamps mounted in holders behind the indicator sheet, a lamp aligned with each character. When assembled an apparently completely dark blank display is presented, but on lighting of a lamp a clear distinct indication appears. Indication characters can be in vertical columns, and there is no need to stagger characters as occurs with conventional displays with "edge-lit" characters.

3 Claims, 9 Drawing Figures

LIGHTED DISPLAY FOR A CONSOLE

This invention relates to a lighted display for a console, particularly but not exclusively for telephone consoles such as are used for small private branch exchanges in offices and other places where a limited number of incoming lines can be selectively connected with a large number of outgoing lines or extensions.

In a telephone console, to indicate which extension is calling, or to which extension an incoming line is connected, or which extensions are busy, a display has been provided on which is provided a pattern or display of extension numbers. One form of such a display has the numbers engraved, or otherwise formed, in a sheet of plastics material. Lamps are mounted along the edge of the sheet such that each lamp emits light in a direction parallel with the face of the sheet — this is referred to as "edge-lit". The light rays travel through the sheet until they impinge on a number. The light is then diffused at the edges of the number to issue from the face of the sheet. This gives an impression of a lighted number.

It will be apparent that there must be provided a lamp for each number. These lamps must be mounted on the edges of the plastic sheet and this creates a limitation on the number of lamps which can be mounted, and on the number of numbers which can be lit. Further, it is necessary to form the numbers in inclined rows so that the numbers are offset relative to each other to permit the light rays for a particular number to reach that number without illuminating any other number. This limits how close the numbers can be positioned on the display.

The present invention provides a display in which the numbers are lighted directly from the back of the display while at the same time presenting a display in which the numbers are not seen until the related lamp is switched on. This is particularly useful in brightly lighted areas as it permits a relatively low level of illumination of the numbers in the display but which at the same time is clear and distinct. Such a display, while particularly applicable to telephone consoles, is also applicable to other forms of console where some form of lighted display information is desired.

Broadly the invention comprises a front transparent cover of a dark coloured plastics material, an indicator layer of dark non-transparent material having transparent numbers or other display characters thereon, and a plurality of lamps mounted to present a lamp aligned with each number or other detail.

The front cover, the indicator sheet and the lamps are assembled to form a sandwich type structure. A further sheet of coloured translucent material can be positioned between lamps and indicator sheet, or between indicator sheet and front cover.

The invention will be readily understood by the following description of one embodiment, by way of example, in conjunction with the accompanying drawings, in which.

Figure 1:
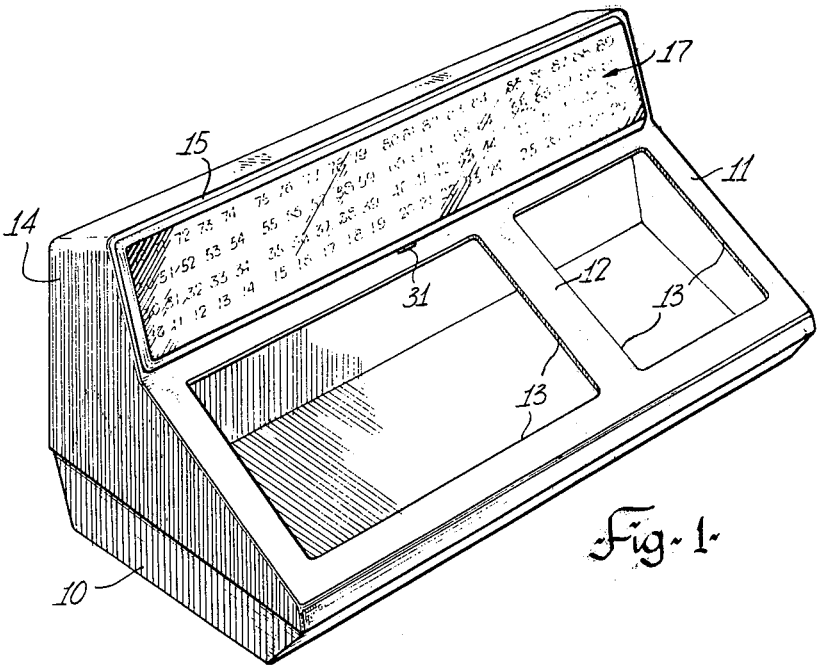
FIG. 1 is a perspective view of a console.
Figure 2:
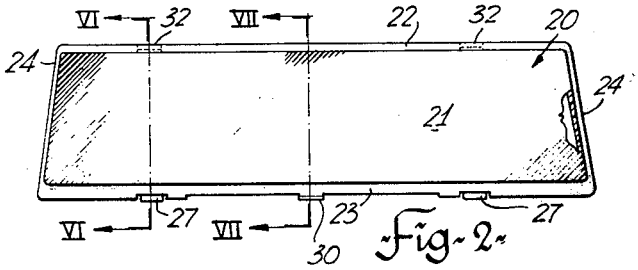
FIG. 2 is a plan view of the display cover.
Figure 5:
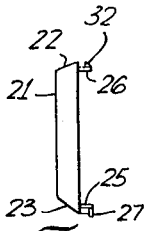
FIGS. 3, 4 and 5 are top, bottom and end views respectively of the cover of FIG. 2.
Figure 4:
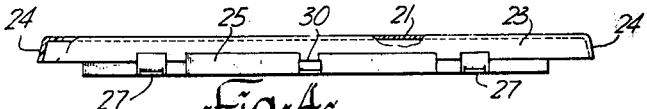
Figure 3:
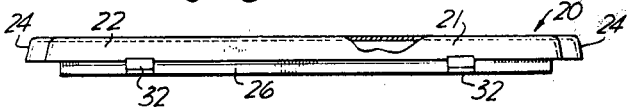

The console illustrated in FIG. 1 comprises a housing base 10 and a housing top 11. The top 11 has an upwardly facing surface 12 at the forward part. In this surface are formed apertures, indicated at 13, for the mounting of pushbutton switches and other items of the attendant unit. At the rear of the surface 12 is an upwardly extending portion 14 having a forwardly facing surface 15. Assembled in an aperture 16 (FIG. 8) extending for the major part of the surface 15 is a lighted display assembly 17.

The lighted display comprises a sandwich construction of a transparent cover, an opaque indicator sheet with transparent characters thereon, and lamps. These items will be described separately. A translucent sheet may also be provided, as will be described.

FIGS. 2 to 7 illustrate the transparent cover 20. The cover is conveniently of molding, of a plastics material, is transparent but of a dark colour, for example dark brown or black. It is generally in the form of a trough or tray, having a planar front surface 21 with top and bottom flanges 22 and 23 respectively, and end flanges 24. The end flanges are inclined slightly outwards from the front surface 21. The top and bottom flanges 22 and 23 are also inclined outwards from the front surface 21 for the same distance as the end flanges 24 but also have further portions 25 and 26 respectively which extend normal to the front surface 21.

Figure 6:
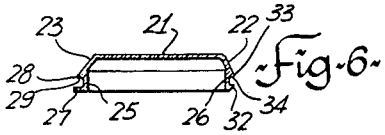
FIGS. 6 and 7 are cross-sections on the lines VI—VI and VII—VII of FIG. 2 respectively.
Figure 7:
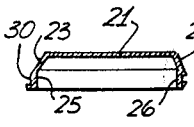

The bottom flange 23 has two retaining ribs 27 formed in the portion 25. The form of the ribs 27 can be seen in FIG. 6. Also illustrated in FIG. 6 is the positioning of the portion 25. The front face of the portion 25 is set back from the edge 28 of the flange 23, to form a projecting ledge 29. This projecting ledge 29 and ribs 27 co-operate to locate and retain the cover in the apertures 17 in the forward facing surface 15, as will be described later.

At the centre of the bottom flange 23 is formed a projection 30. This projection fits in a recess 31 formed in the edge of the aperture 17, and locates the cover endwise, in relation to the housing top.

The top flange 22 has two ribs 32. The form of these ribs are seen in FIG. 6. As with the bottom flange 23, the front face of the portion 26 extending from the top flange 22 is set back from the edge 33 of the flange 22, to form a projecting ledge 34. Projecting ledge 34 and ribs 32 also co-operate to locate and retain the cover in the aperture 17.

Figure 8:
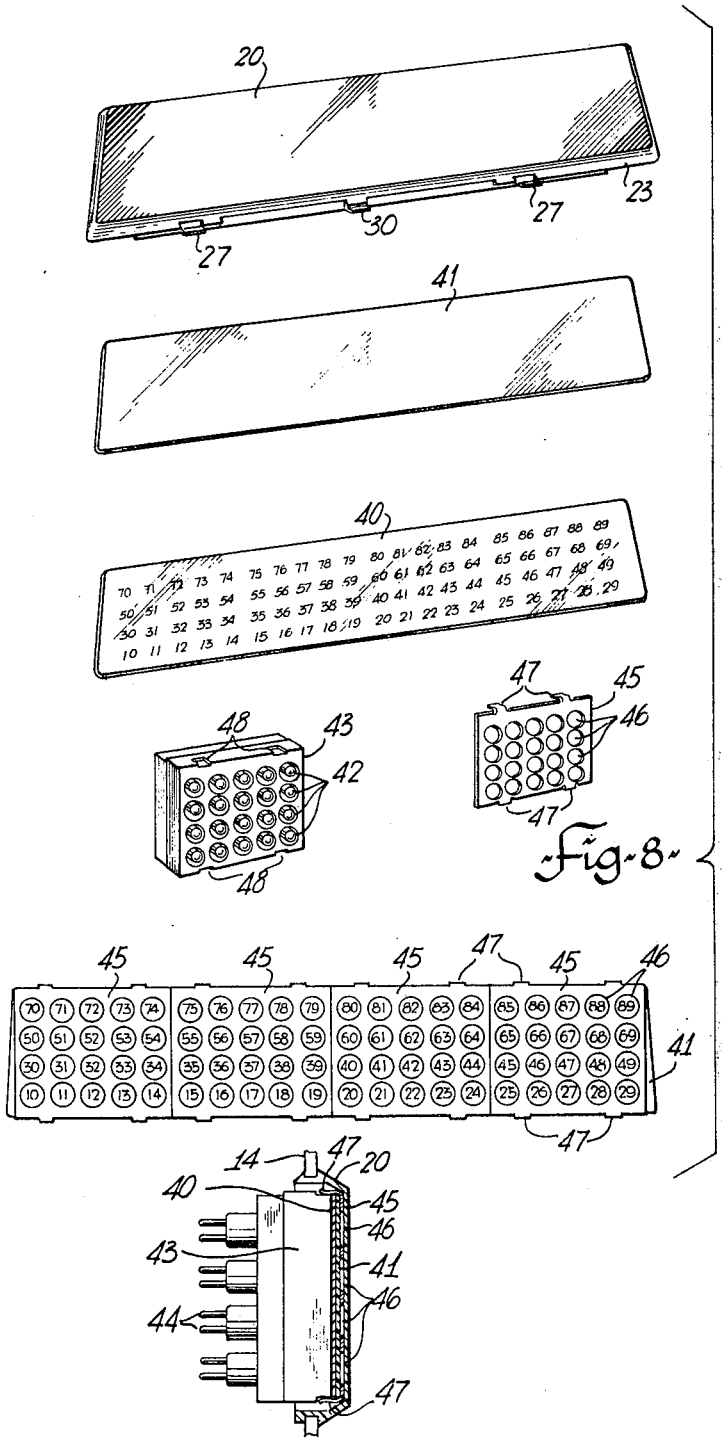
FIG. 8 is a perspective exploded view of the various items of the lighted display assembly.
Figure 9:
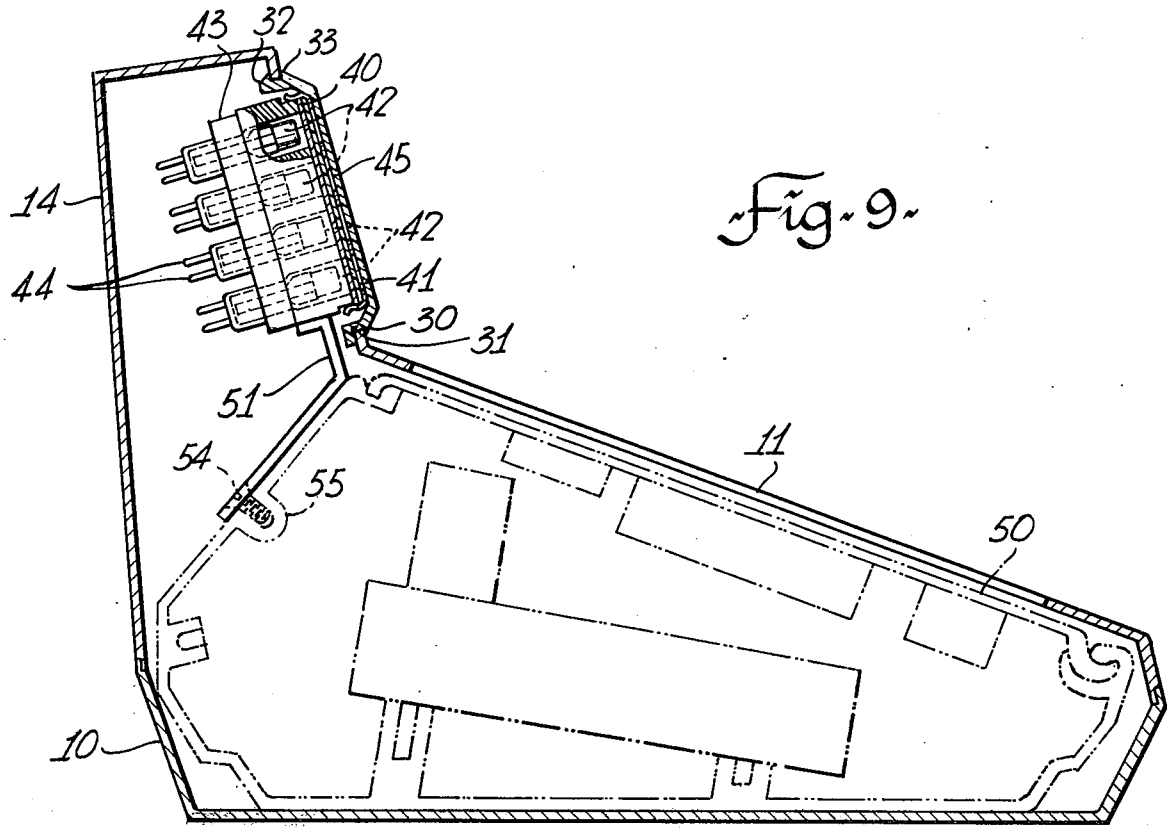
FIG. 9 is a cross-section, of an assembled console including a lighted display.

FIGS. 8 and 9 illustrate the assembly of the lighted display. In FIG. 8 can be seen the various items, the transparent cover 20, the indicator sheet 40, a translucent sheet 41 and lamps 42 in lampholder unit 43. Electrical leads to the lamps 42 are connected to terminals 44. A number of lampholder units 43 are aligned across the console, the number of lampholder units — and thus the number of lamps, depending upon the number of lines connected.

The indicator display can comprise only the front cover 20, the indicator sheet 40 and lampholder units 43. For ease in assembly the indicator sheet 40 is attached to the front surfaces of the lampholder units 43 by thin perforated metal plates or clips 45. clips 45 are in the form of a thin sheet, usually metal, with apertures 46 therein, one or more apertures aligned with each lamp. On the top and bottom edges of each clip are formed resilient legs 47. The resilient legs fit into recesses 48 in the top and bottom surfaces of the lampholder units 43. As an additional feature, a translucent sheet 41 can also be provided, generally coloured. Sheet 41 can be positioned either between the cover 20 and indicator sheet 40, or between indicator sheet 40 and lampholder units 43. Conveniently sheet 41 can be coloured to give a colour to the lighted characters.

The dark transparent cover and dark opaque indicator sheet co-operate to form what appears to be a black, completely opaque display when assembled with the lampholder units. Only when a lamp is lighted does an indicator character appear on the display. The characters can be arranged in horizontal rows and vertical columns.

The lampholder units are mounted on an inner housing 50 by a bracket 51 extending the major part of the length of the lampholder units. The bracket is attached to the inner housing by screws 54 inserted into molded recesses 55 in the inner housing 50.

The indicator sheet 40 is placed against the lampholders and the clips 45 pushed on. If a translucent sheet 41 is used, it is positioned in front of or behind the indicator sheet 40 prior to assembly to the lampholder units 43. The indicator sheet is held firmly against the front faces of the lampholder units. The front cover is then positioned on the aperture in the forwardly facing surface of the housing top 11 and attached by interengagement of the various projecting sides and ledges. It is possible to assemble the cover 20 to the housing top, separately to assembling the lampholder units, indicator sheet and other items to the inner housing. The two housings are then assembled. The front cover is very close to, and may be touching the indicator sheet 40, or translucent sheet 41 if used and positioned over the indicator sheet.

What is claimed is:

1. A console for a telecommunications unit including a housing base and a housing top, said base and top cooperating to form an enclosure for telecommunications apparatus, said housing top including a forward part having an upwardly facing surface with at least one aperture therein for the mounting of apparatus items, and a rear part having an upwardly extending portion, the upwardly extending portion having a forwardly facing surface with an aperture therein extending for the major part of the forwardly facing surface and having top and bottom edges; and a lighted display positioned in said aperture of said forwardly facing surface and extending into said upwardly extending portion, said lighted display comprising;

a front cover of dark colored translucent material positioned in said aperture in said forwardly facing surface said front cover having a planar front surface and top and bottom flanges;

a light indicator assembly mounted behind said front cover, said light indicator assembly including at least one lampholder unit mounted in said upwardly extending portion and having a plurality of lamps therein; an indicator sheet of dark opaque material having a plurality of transparent indicator characters thereon spaced in a predetermined pattern with a character in front of each lamp; and an apertured plate releasably attached to said lamp unit and including a plurality of apertures therein, an aperture aligned with each lamp, the indicator sheet portioned between said plate and said lampholder unit and held in close contact with said lampholder unit by said plate, the indicator sheet also positioned in close proximity to said planar front surface of said front cover; and interengaging formations on said top and bottom edges of said aperture in said forwardly facing surface and on said top and bottom flanges of said front cover, said interengaging formations releasably attaching said front cover to said forwardly facing surface with said front cover positioned in said aperture.

2. A display as claimed in claim 1, including a translucent sheet of coloured material positioned between said perforated plate and said indicator sheet.

3. A display as claimed in claim 1, including a translucent sheet of coloured material positioned between said indicator sheet and said lamp unit.

* * * * *